US009670671B2

(12) United States Patent
Xiao

(10) Patent No.: US 9,670,671 B2
(45) Date of Patent: Jun. 6, 2017

(54) HATCH WITH THERMALLY BROKEN FRAME

(71) Applicant: The Bilco Company, West Haven, CT (US)

(72) Inventor: Ming Xiao, Woodbridge, CT (US)

(73) Assignee: The Bilco Company, New Haven, CT (US)

( * ) Notice: Subject to any disclaimer, the term of this patent is extended or adjusted under 35 U.S.C. 154(b) by 223 days.

(21) Appl. No.: 14/621,796

(22) Filed: Feb. 13, 2015

(65) Prior Publication Data

US 2016/0237680 A1 Aug. 18, 2016

(51) Int. Cl.

| | |
|---|---|
| ***E04B 7/18*** | (2006.01) |
| ***E06B 5/01*** | (2006.01) |
| ***E04D 13/00*** | (2006.01) |
| ***E04D 13/035*** | (2006.01) |
| ***E06B 3/263*** | (2006.01) |

(52) U.S. Cl.

CPC ..... *E04B 7/18* (2013.01); *E04D 13/00* (2013.01); *E04D 13/0354* (2013.01); *E06B 3/26303* (2013.01); *E06B 5/01* (2013.01)

(58) Field of Classification Search

CPC . E04D 2003/3612; E04D 13/03; E04D 13/14; E06B 3/267; E06B 3/2675

USPC ..... 49/DIG. 1; 52/18, 19, 79.7, 200, 717.02

See application file for complete search history.

(56) References Cited

U.S. PATENT DOCUMENTS

| | | | | |
|---|---|---|---|---|
| 4,231,207 | A * | 11/1980 | Kern | E06B 3/273 49/DIG. 1 |
| 4,299,059 | A | 11/1981 | Smith | |
| 4,314,424 | A * | 2/1982 | Gordon | E06B 3/308 49/400 |
| 8,851,790 | B1 | 10/2014 | Joyce | |
| 2008/0178552 | A1* | 7/2008 | Dampierre | E06B 3/273 52/656.2 |
| 2008/0245027 | A1* | 10/2008 | Lambertini | E06B 3/26347 52/717.02 |
| 2009/0226660 | A1 | 9/2009 | Dampierre | |

(Continued)

FOREIGN PATENT DOCUMENTS

| | | | |
|---|---|---|---|
| BE | 900741 | A1 | 2/1985 |
| DE | 3231968 | A1 | 10/1983 |

(Continued)

*Primary Examiner* — William Gilbert

(74) *Attorney, Agent, or Firm* — Wiggin and Dana LLP; Gregory S. Rosenblatt

(57) ABSTRACT

A roof access hatch, which utilizes thermal breaks is disclosed. This roof access hatch has a cover with a first metallic exterior surface spaced from a first metallic interior surface by at least a first insulation layer, where the first metallic exterior surface is thermally isolated from the first metallic interior surface. A first thermal break spans the insulation layer and is in contact with both the metallic exterior surface and the metallic interior surface. A frame supports the cover. This frame has a second metallic exterior surface separated from a second metallic interior surface by at least a second insulation layer, where the second metallic exterior surface is thermally isolated from the second metallic interior surface by a thermal break component. A non-metallic, thermally insulating gasket is disposed between the cover and the frame.

19 Claims, 8 Drawing Sheets

(56) References Cited

U.S. PATENT DOCUMENTS

| | | | | |
|---|---|---|---|---|
| 2009/0229202 | A1 | 9/2009 | Dampierre | |
| 2010/0018138 | A1* | 1/2010 | Lundsgaard | E04D 13/0354 52/200 |

FOREIGN PATENT DOCUMENTS

| | | | |
|---|---|---|---|
| EP | 1870542 | B1 | 12/2007 |
| EP | 2519702 | B1 | 7/2012 |

* cited by examiner

HATCH WITH THERMALLY BROKEN FRAME

CROSS REFERENCE TO RELATED APPLICATION

N.A.

U.S. GOVERNMENT RIGHTS

N.A.

BACKGROUND

Field

Disclosed herein is a hatch to be used to provide access to a flat or slightly sloped roof. More particularly, the hatch includes a plurality of thermal breaks effective to decrease the loss of heat through the hatch.

Description of the Related Art

Thermal breaks are commonly used in the frames of windows and doors because a thermal break interrupts the flow of heat thereby providing improved thermal insulation. Thermal breaks are disclosed in United States patent application publication number US 2009/0226660 A1, titled, "Heat Insulating Body for Forming Sections for Thermal Break Door and Window Frames." The thermal breaks are described as having a first aluminum part exposed externally that is separated from a second aluminum part that is exposed internally by a heat-insulating material. Generally, this heat-insulating material is a plastic, typically, a polyamide. The gap between the first aluminum part and the second aluminum part interrupts the conduction of heat between the outer part and inner part and provides the frame with a high heat-insulating power. US 2009/0226660 A1 is incorporated by reference herein in its entirety.

EP 2519702 B1, titled "Panel Assembly Comprising a Panel and a Frame" discloses a roof hatch intended to allow access to a roof. The transfer of heat between the inside of a building and outside the building is reduced by including a thermal separation between outward facing parts of the roof hatch and inward facing parts of the roof hatch. The thermal separation is a strip of insulation disposed between edges of the inner facing and outer facing parts of the roof hatch.

There remains, however, a need for more energy efficient roof hatches.

BRIEF SUMMARY OF THE DISCLOSURE

In one embodiment, a compound thermal break component is disclosed. This compound thermal break includes a first thermal break component that has a first metallic heat conducting portion and a second metallic heat conducting portion separated by at least one thermally insulating portion. The first metallic heat conducting portion and the second metallic heat conducting portion are generally parallel to each other in the direction of a first length-wise axis. The compound thermal break also includes a second thermal break component having a third metallic heat conducting portion and a fourth metallic heat conducting portion separated by at least one thermally insulating portion wherein the third metallic heat conducting portion and the fourth metallic heat conducting portion are generally parallel to each other in the direction of a second length-wise axis. The first length-wise axis is perpendicular to the second length-wise axis.

In a second embodiment, a roof access hatch, which utilizes thermal breaks is disclosed. This roof access hatch has a cover with a first metallic exterior surface spaced from a first metallic interior surface by at least a first insulation layer, where the first metallic exterior surface is thermally isolated from the first metallic interior surface. A first thermal break spans the insulation layer and is in contact with both the metallic exterior surface and the metallic interior surface. A frame supports the cover. This frame has a second metallic exterior surface separated from a second metallic interior surface by at least a second insulation layer, where the second metallic exterior surface is thermally isolated from the second metallic interior surface. A non-metallic, thermally insulating gasket is disposed between the second metallic interior and exterior surfaces and the first metallic interior section.

BRIEF DESCRIPTION OF THE DRAWINGS

Like reference numbers and designations in the various drawings indicated like elements.

DETAILED DESCRIPTION

Figure 1:
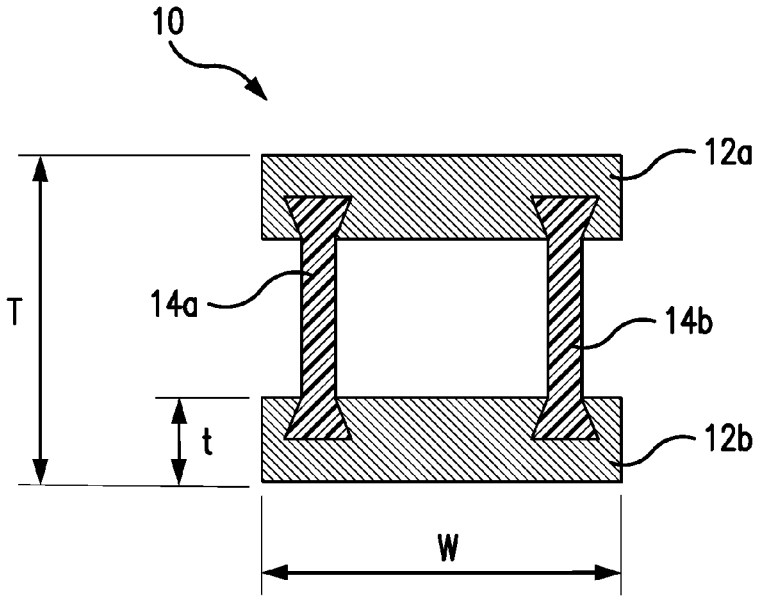
FIG. 1 is a cross-sectional view of a thermal break component for use with the roof hatch described herein.
Figure 2:
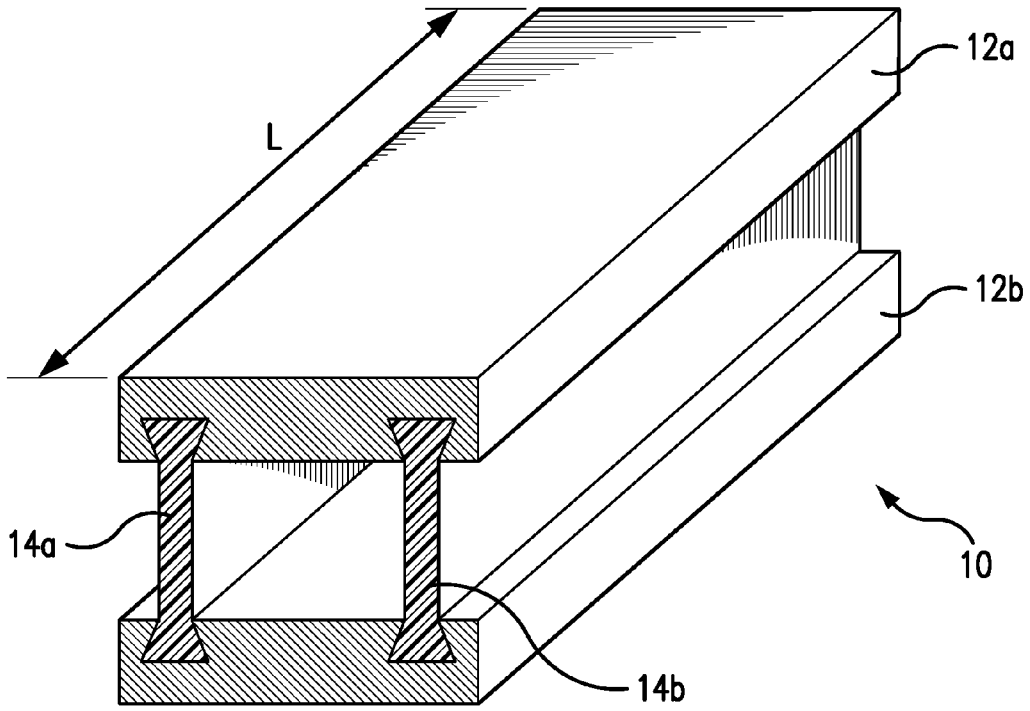
FIG. 2 illustrates the thermal break component of FIG. 1 in front planar view.
Figure 8:
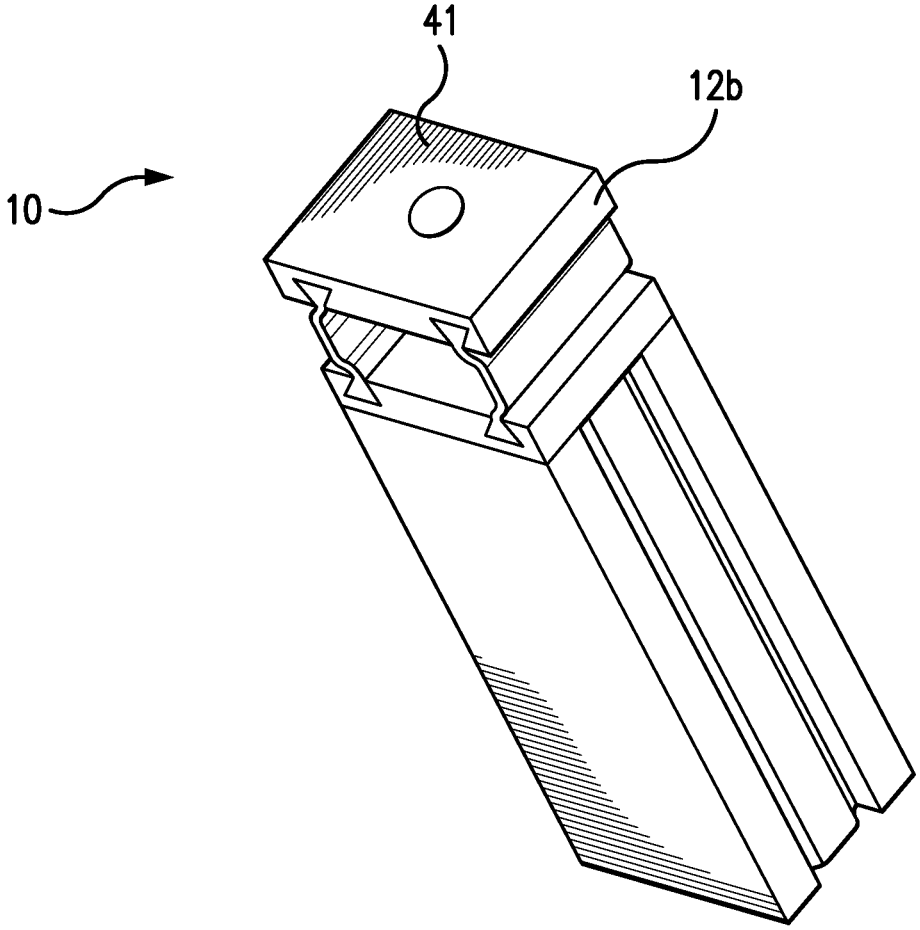
FIG. 8 is a perspective view of a thermal break component having a hole for mounting hardware.

FIG. 1 is a cross-sectional view of a thermal break component 10 for use with a roof hatch as described herein. The thermal break component 10 has two parallel metallic heat conducting portions 12*a*, 12*b* separated by thermally insulating portions 14*a*, 14*b*. Preferably, the two metallic heat conducting portions 12*a*, 12*b* are formed from aluminum or an aluminum alloy, such as aluminum alloy 6063T5 (nominal composition, by weight, 0.7 Mg, 0.4 Si and the balance aluminum). As shown in FIGS. 1 and 2, the heat conducting portions 12*a*, 12*b* are preferably rectangular in cross-section to facilitate extrusion and attachment to roof hatch components. The heat conducting portions 12*a*, 12*b* have a thickness, t, which is sufficient to receive a hole, as seen in FIG. 8. With reference back to FIG. 1, this thickness, t, is at a minimum 0.1 inch and is preferably from 0.15 inch to 0.25 inch and most preferably is from 0.175 inch to 0.20 inch. The hole is useful to replace nuts and cover spacers when hardware is attached to the roof hatch.

The heat conducting portions 12*a*, 12*b* have a nominal width, w, of one inch. The thermal break component has a nominal total thickness, T, of 0.75 inch. Referring to FIG. 2, the extruded length, L, of a thermal break component 10 may be any desired length up to the full width of a roof hatch portion. The thermally insulating portions 14*a*, 14*b* are typically formed from a rigid polymer such as polyimide, for example, polyimide GF25.

Figure 3:
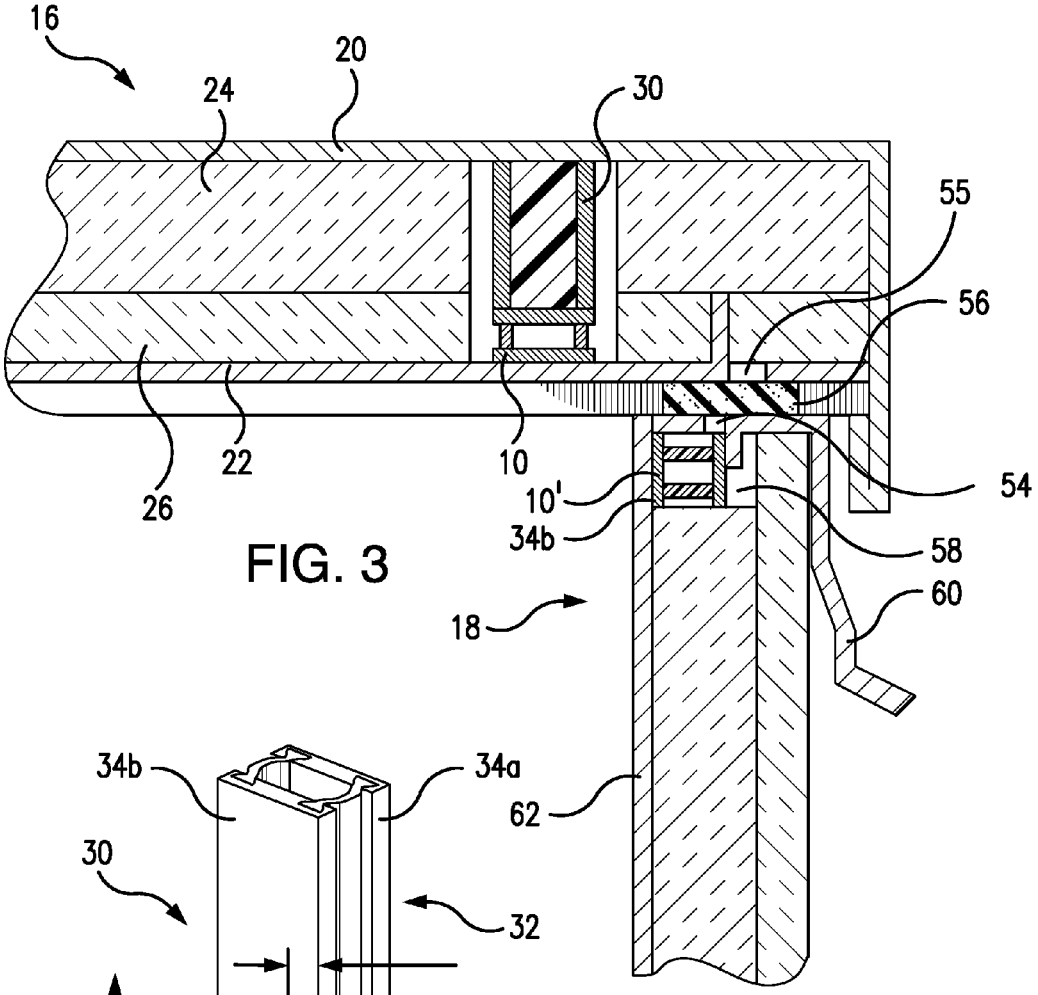
FIG. 3 is a cross-sectional view of a portion of a roof hatch as described herein.
Figure 7:
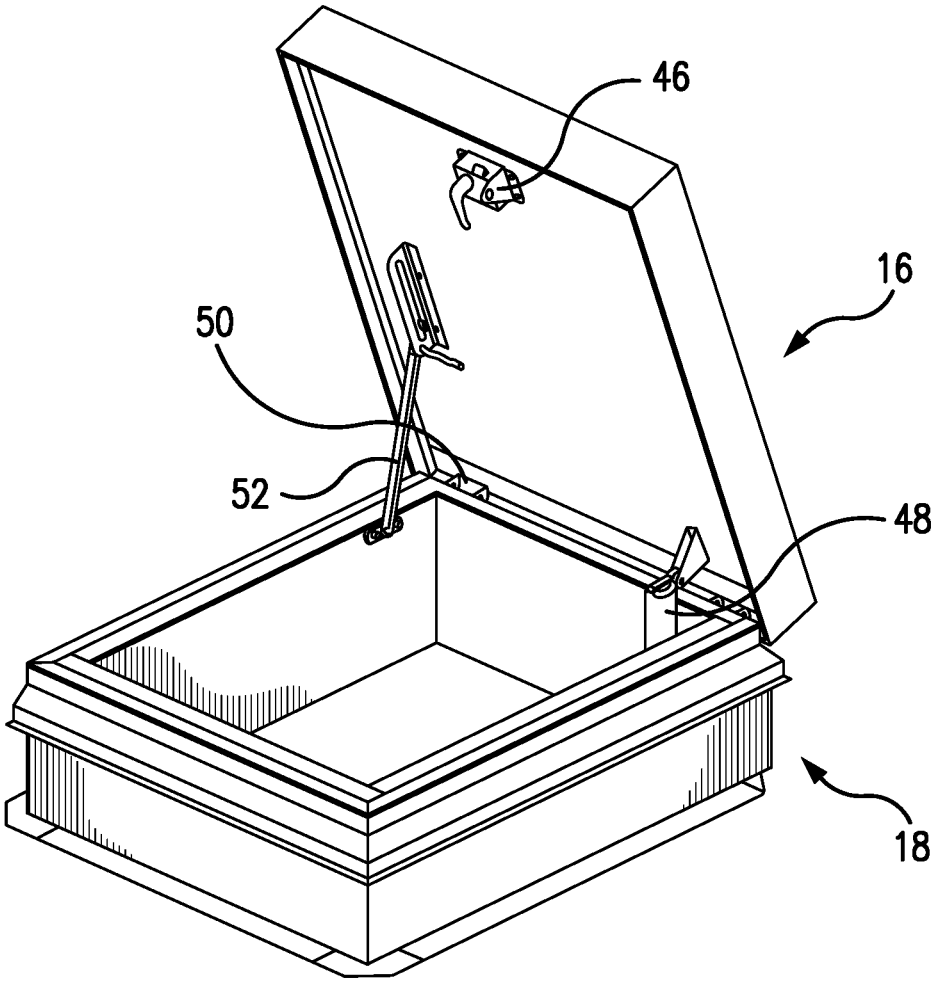
FIG. 7 is a perspective view of the roof hatch as described herein.

FIG. 3 is a cross-sectional representation of a corner of the roof hatch illustrating a cover 16 and a frame 18 both including at least one thermal break component. As illustrated in FIG. 7, the frame 18 supports the cover 16. Hinges 50 are adjacent a first edge of the cover 16 and pivotally join the cover 16 to the frame 18. Locking handle 46 is located at an opposing second edge of the cover 16.

Referring back to FIG. 3, the cover 16 has an exterior surface 20 and an interior surface 22 both made from a thin sheet of metal. The exterior surface 20 may be formed from 11 gauge (0.090 inch thick) aluminum alloy, for example, aluminum alloy 3003 (nominal composition by weight of 1.2% Mn, 0.12% Cu and the balance Al) and the interior surface may be formed form 0.04 inch thick aluminum alloy 3003. The exterior surface 20 and the interior surface 22 are separated by insulation, such as by a first insulation layer 24 and a second insulation layer 26. The cover is designed to withstand a force of 40 lbs./ft$^2$ or higher. To increase the strength of the exterior surface 20, a preferred option is to include one or more compound thermal break components 30 that span the thicknesses of the first 24 and second 26 insulation layers contacting and supporting the exterior surface 20 and interior surface 22.

Figure 4:
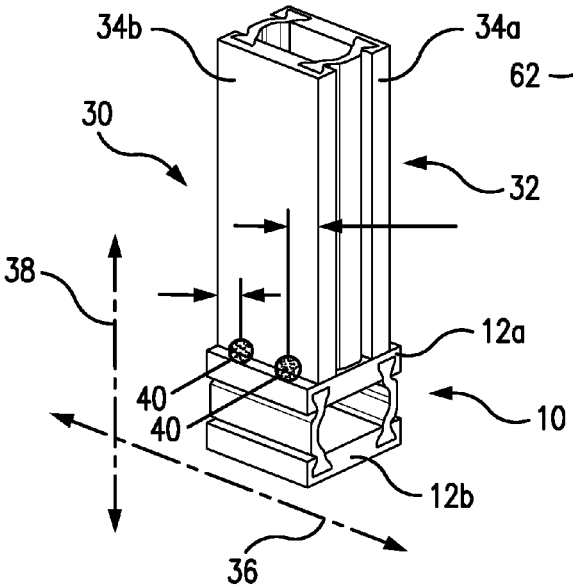
FIG. 4 is a side planar view of a thermal break used to provide hardware mounting to the roof hatch of FIG. 3.
Figure 6:
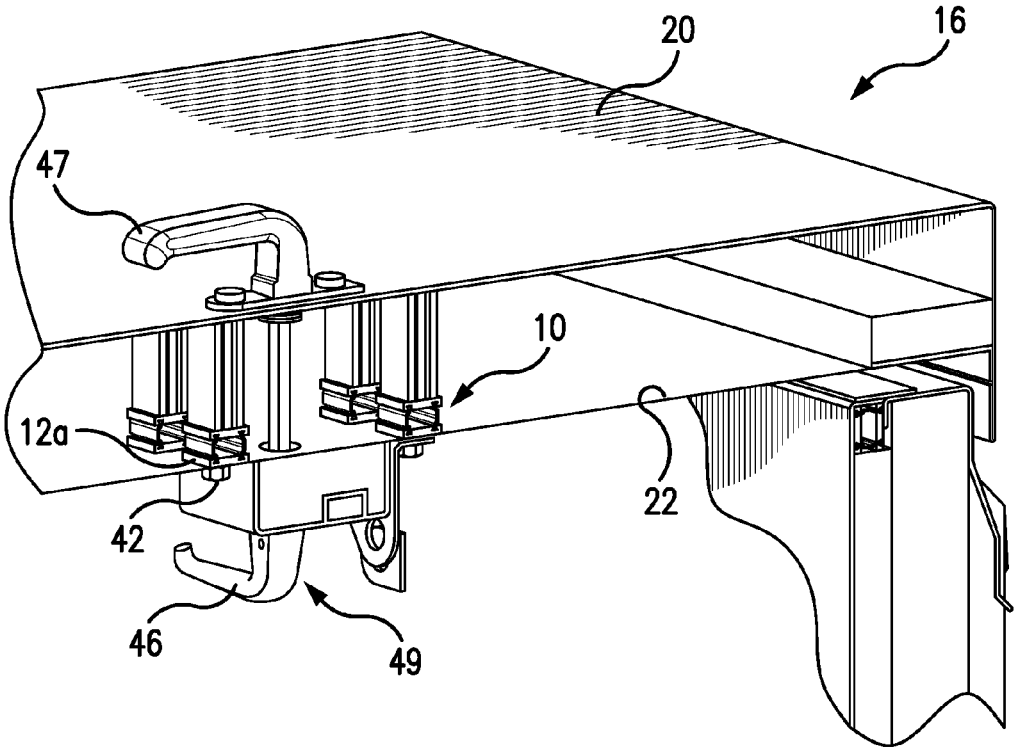
FIG. 6 is a broken perspective view of a roof hatch showing thermal break components used for mounting hardware.

With reference to FIG. 4, a compound thermal break component 30 is formed by joining a first thermal break component 10 to a second thermal break component 32 in an orientation such that metallic heat conducting portions 12*a*, 12*b* and 34*a*, 34*b* do not form a continuous, uninterrupted metallic path between exterior surface 20 and interior surface 22 (FIG. 3). As shown in FIG. 4, this is accomplished by having the length-wise axis 36 of the first thermal break component 10 be perpendicular to the length-wise axis 38 of the second thermal break component 32. When the heat conducting portions are formed from an aluminum-base alloy, joining may be by a weld 40. The length of the second thermal break component 32 is that necessary for the compound thermal break component 30 to span the distance between exterior surface 20 and interior surface 22. In this way, metallic heat conducting portion 12*b* abuts the interior surface 22. This metallic heat conducting portion 12*b* may then be provided with a hole for mounting hardware as best shown in FIG. 6.

Figure 5:
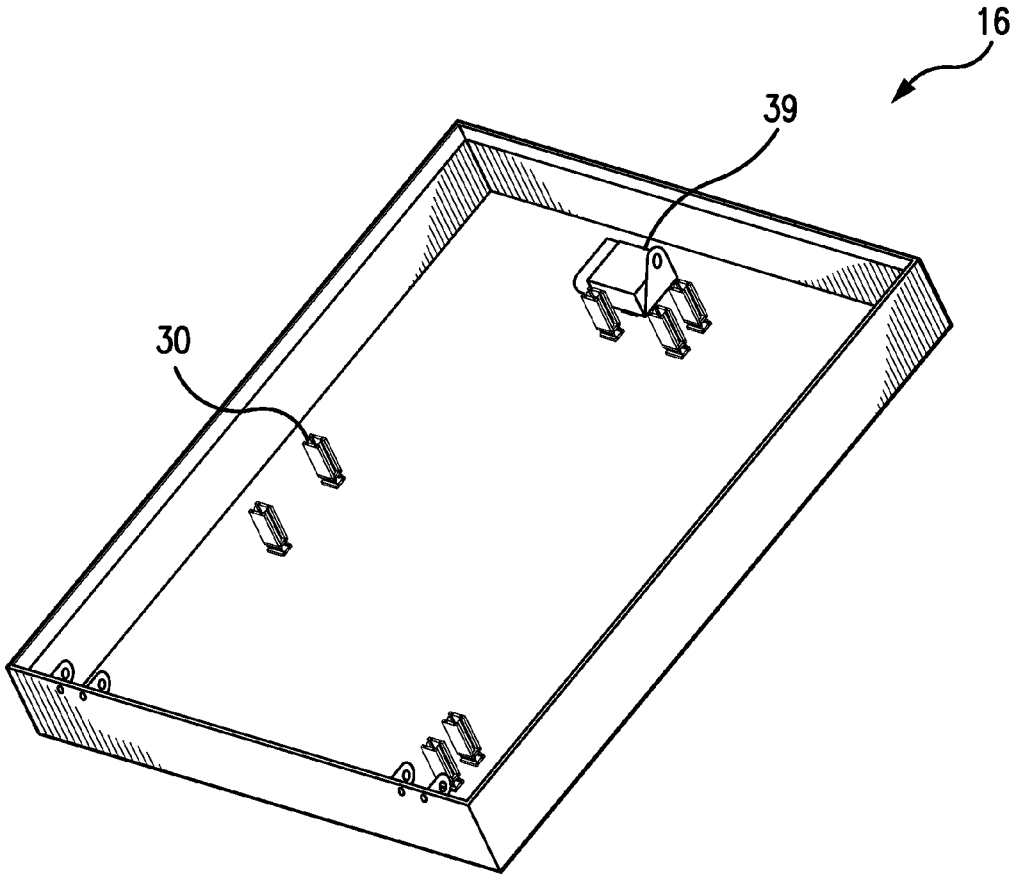
FIG. 5 is a bottom planar view of a first embodiment of a cover portion of the roof hatch showing thermal break components that provide hardware mounting sites preferably for use with a smaller size hatch.

Any number of compound thermal break components 30 may be attached to the insulation-facing sides of the cover 16. As shown in FIG. 5, these compound thermal break components may receive mounting supports 39 for attachment of hardware, such as locking handles, attached in the cover 16. With reference to FIG. 8, holes 41 are formed in one of the metallic heat contacting portions 12*b* of the first thermal break component 10. With reference to FIG. 6, if the fastener 42 is a screw, the walls circumscribing the holes 41 may be threaded to engage the threads of the screw or smooth and slightly smaller than the diameter of a self-threading screw. If the fastener 42 is a bolt or a rivet, the holes 41 may be smooth and enable the bolt or rivet to pass through. Fasteners 42 join hardware 44, such as locking handle 46 to the cover 16 without creating a thermal path from the exterior surface 20 to the interior surface 22. The exterior handle 47 may be rubber coated to prevent the flow of heat through the handle hardware.

FIG. 7 shows exemplary hardware that may be fastened to a first thermal break component 10, 10' (FIG. 3) located in either the cover 16 or the frame 18. For example, lock 46, compression spring 48, hinge 50, and cover support mechanism 52 (to hold the cover open). The first thermal break component 10' is useful to replace weld nuts and back plate for mounting hardware on the frame.

Figure 9:
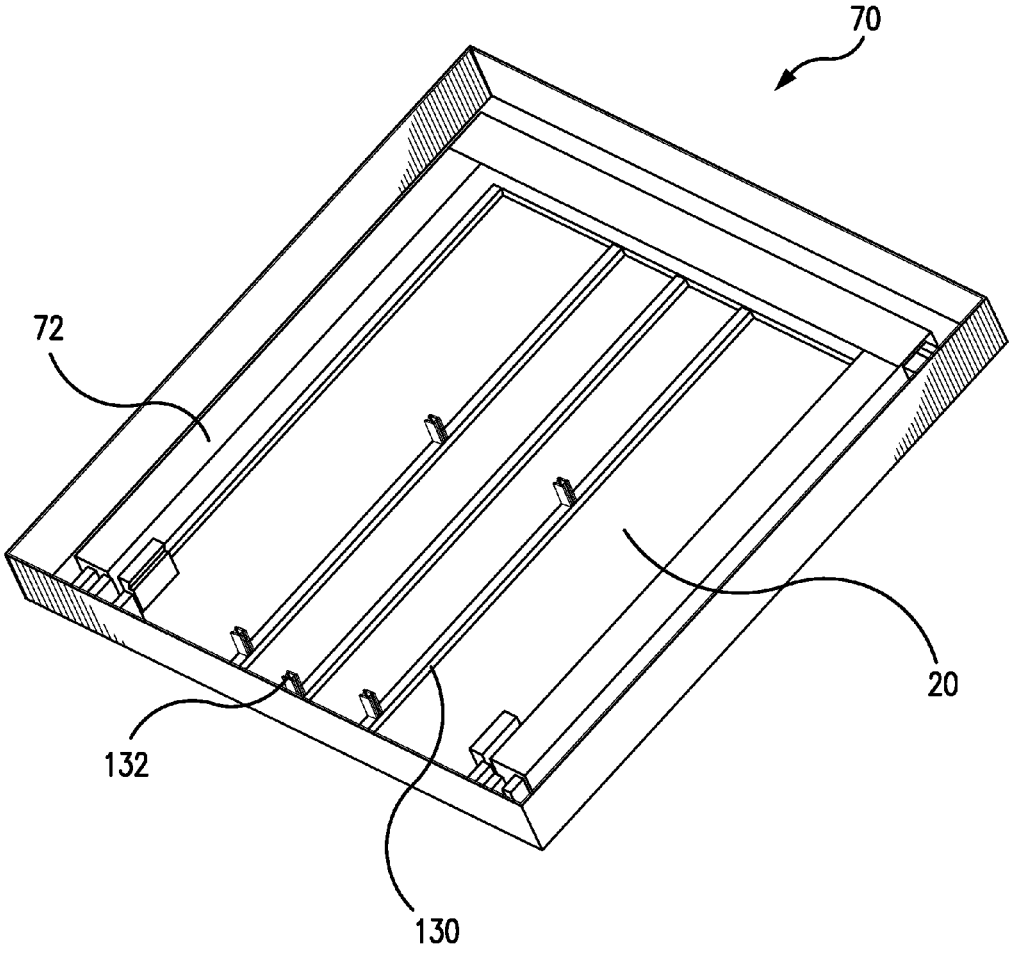
FIG. 9 is a bottom planar view of a second embodiment of a cover portion of the roof hatch showing thermal break components that provide structural support for stiffening, preferably for use with a larger size hatch.

FIG. 9 shows a second cover 70 in an embodiment typically for use with larger covers. Thermal break components 130 extend for an extended length along the insulation-facing side of exterior surface 20. Any number of, preferably parallel running, thermal break components 130 may be utilized. Second thermal breaks 132 are attached to span the thickness of the insulation and contact the interior surface (not shown in FIG. 9). A mounting fixture 72, such as a U-shaped sheet of an aluminum alloy may be attached to select thermal break components 130 to receive holes for the mounting of hardware.

With reference back to FIG. 3, gap 55 is a thermal break between exterior surface 20 and interior surface 22 creating a thermal break without extra parts. Also, a thermally isolating elastomeric gasket 56 provides an air tight seal between the frame 18 and cover 16. Gap 54 and gap 58 thermally isolate flashing 60 from the interior surface 62 of the frame 18. Thermal break component 10' may be used to attach hardware.

Figure 10:
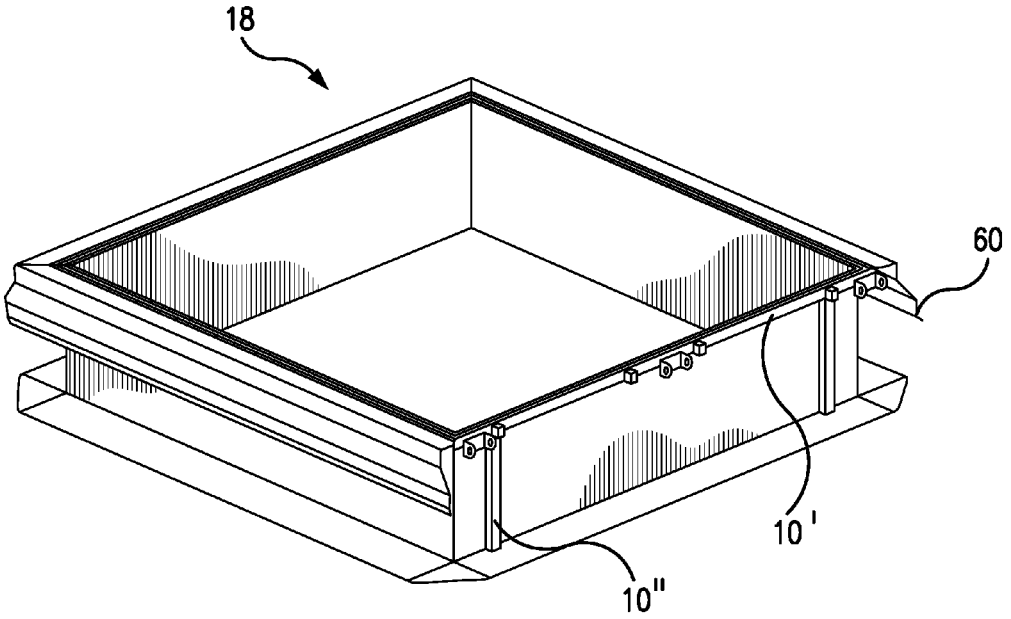
FIG. 10 is a side perspective view of a frame utilizing a thermal break component to provide structural support for stiffening and to support flashing.

While use of the thermal break components has been described in relation to the cover, these components 10', 10" may also be used to support and stiffen, and provide sites for hardware mounting, to the frame 18. They may also be used to support flashing 60 as shown in FIG. 10.

EXAMPLES

The following example further illustrates the thermal transmittance of the roof access hatch described herein. The thermal transmittance of a roof access hatch of the type described in EP 2519702 ("Prior Art Hatch") was compared to the thermal transmittance of the roof access hatch disclosed herein ("Disclosed Herein Hatch"). An NPL (National Physical Laboratory—United Kingdom) rotatable wall-guarded hot-box which conforms to the requirements of BS EN ISO 8990:1996 was used.

Measurement equipment with calibration traceable to National Standards (UK) was used with the measurement procedures defined in BS EN ISO 12567-2. This is an air-to-air method requiring no surface measurement of the structure being tested. The overall measurement uncertainty was estimated to be within ±6.5% providing a level of confidence of approximately 95%.

Thermal transmittance measurements were made in an NPL Rotatable Wall-Guarded Hot-Box described in NPL Report CBTLM 25. Main features of this equipment are:

Interior dimensions of hot-box—2.4 m×2.4 m;

All surfaces "seen" by the test element are matte black;

There are twenty five air temperature sensors, 75 mm from the holder panel face, positioned at the centers of squares of equal areas in both the hot and cold boxes; and The heat flow direction is vertically up.

Both the Prior Art Hatch and the Disclosed Herein Hatch utilized aluminum-base alloys for metallic components and were installed in the test apparatus to replicate thermal performance when installed on a roof in the "curb" mounting configuration. In that configuration, the entire roof hatch was above the surround panel surface—which is representative of an installation where the product is above the building envelope insulation.

| | Prior Art Hatch | Disclosed Herein Hatch |
|---|---|---|
| Height of Aperture (m) | 0.902 | 0.902 |
| Width of Aperture (m) | 0.702 | 0.702 |
| Internal Depth (m) | 0.289 | 0.326 |

Utilizing the data from Table 1 below, the following thermal transmittance values were determined:

| | Environmental Temperature ° C. | Thermal Transmittance W/(m$^2$ · K) |
|---|---|---|
| Prior Art Hatch | 11.58 | 3.9 |
| Disclosed Herein Hatch | 11.62 | 3.7 |

The above thermal transmittance data indicates that the thermal transmittance of the Disclosed Hatch is lower (better) than that of the Prior Art Hatch.

The U-value of a projecting product such as a roof access hatch is calculated by dividing the heat transfer across the system (measured in Watts) by the environmental temperature difference across the test element (measured in degrees K) multiplied by the area of the opening in the building envelope (measured in m$^2$). If the total surface area of the product (called the developed area) is used, rather than the area of the opening, a $U_d$ value is obtained. The $U_d$ value is a good indication of the thermal performance of the individual components that make up the product. The following $U_d$ values were obtained:

| | Prior Art Hatch | Disclosed Herein Hatch |
|---|---|---|
| Developed Internal Area | 1.5601 m$^2$ | 1.6788 m$^2$ |
| Power Through Roof Hatch System | 47.7830 W | 44.97 W |
| Environmental Temp. Difference | 19.22° C. | 19.28° C. |
| $U_d$-Value | 1.59 W/m$^2$ · K | 1.39 W/m$^2$ · K |

The difference in $U_d$—Value indicates that the $U_d$—Value of the Disclosed Hatch is lower (12.6% better for heat insulation) than that of the Prior Art Hatch.

The following measured/calculated data was obtained per the above described methods used to calculate the above values:

TABLE 1

| | Prior Art Hatch | Disclosed Herein Hatch |
|---|---|---|
| Test Element Dimensions (m) | | |
| Aperture Height | 0.902 | 0.902 |
| Aperture Width | 0.702 | 0.702 |
| Internal Depth | 0.289 | 0.326 |
| Measured Values (° C.) | | |
| Mean Warm Air Temperature | 21.83 | 21.85 |
| Mean Warm Baffle Temperature | 21.17 | 21.33 |
| Mean Hot Reveal Temperature | 18.62 | 18.62 |
| Mean Cold Air Temperature | 1.96 | 1.97 |
| Mean Cold Baffle Temperature | 2.03 | 2.02 |

TABLE 1-continued

| | Prior Art Hatch | Disclosed Herein Hatch |
|---|---|---|
| Measured Values | | |
| Power to Hot Box | 71.124 W | 68.265 W |
| Air Flow Rate in Cold Box | 1.35 m/s | 1.32 m/s |
| Air Flow Rate in Hot Box | 0.32 m/s | 0.34 m/s |
| Calculated Values | | |
| Heat Flux Density | 75.477 W/m$^2$ | 71.034 W/m$^2$ |
| Warm Side Convective Fraction | 0.453 | 0.447 |
| Cold Side Convective Fraction | 0.851 | 0.846 |
| Warm Side Environmental Temp. | 21.18° C. | 21.26° C. |
| Cold Side Environmental Temp. | 1.97° C. | 1.98° C. |
| Environmental Temp. Difference | 19.22° C. | 19.28° C. |
| Environmental Temp. Mean | 11.58° C. | 11.62° C. |
| Measured Thermal Transmittance | 3.928 W/(m$^2$ · K) | 3.684 W/(m$^2$ · K) |

One or more embodiments of the present invention have been described. Nevertheless, it will be understood that various modifications may be made without departing from the spirit and scope of the invention. Accordingly, other embodiments are within the scope of the following claims.

What is claimed is:

1. A compound thermal break component effective to join, support and stiffen two surfaces, comprising:

a first thermal break component having a first metallic heat conducting portion and a second metallic heat conducting portion separated by at least one thermally insulating portion wherein the first metallic heat conducting portion and the second metallic heat conducting portion are generally parallel to each other in the direction of a first length-wise axis;

a second thermal break component having a third metallic heat conducting portion and a fourth metallic heat conducting portion separated by at least one thermally insulating portion wherein the third metallic heat conducting portion and the fourth metallic heat conducting portion are generally parallel to each other in the direction of a second length-wise axis; and a joint attaching the third metallic heat conducting portion and the fourth metallic heat conducting portion to the first metallic heat conducting portion;

wherein the first length-wise axis is perpendicular to said second length-wise axis.

2. The compound thermal break component of claim 1 wherein the third metallic heat conducting portion and the fourth metallic heat conducting portion are thermally isolated from the second metallic heat conducting portion.

3. The compound thermal break component of claim 2 wherein said second metallic heat conducting portion includes a hole.

4. The compound thermal break component of claim 3 wherein walls circumscribing said hole are threaded.

5. The compound thermal break component of claim 2 wherein the joint is a first weld contacting the first metallic heat conducting portion and the third metallic heat conducting portion and a second weld contacting the first metallic heat conducting portion and the fourth metallic heat conducting portion.

6. The compound thermal break component of claim 5 wherein the first metallic heat conducting portion, the second metallic heat conducting portion, the third metallic heat conducting portion and the fourth metallic heat conducting portion are aluminum or an aluminum base alloy.

7. The compound thermal break component of claim 6 wherein the first metallic heat conducting portion, the second metallic heat conducting portion, the third metallic heat conducting portion and the fourth metallic heat conducting portion each have substantially equal thicknesses and widths, said third metallic heat conducting portion and the fourth metallic heat conducting portion having a length that is variable and effective to span a distance between the two surfaces.

8. The compound thermal break component of claim 7 wherein the first thermal break component and the second thermal break component have a nominal total thickness of 0.75 inch.

9. A roof access hatch, comprising:

a cover having a first metallic exterior surface spaced from a first metallic interior surface by at least a first insulation layer, wherein the first metallic exterior surface is thermally isolated from the first metallic interior surface;

a first thermal break spanning the insulation layer and in contact with both said metallic exterior surface and said metallic interior surface, said first thermal break having a first metallic heat conducting portion and a second metallic heat conducting portion separated by at least one thermally insulating portion wherein the first metallic heat conducting portion and the second metallic heat conducting portion are generally parallel to each other in a direction of a first length-wise axis;

a second thermal break component having a third metallic heat conducting portion and a fourth metallic heat conducting portion separated by at least one thermally insulating portion wherein the third metallic heat conducting portion and the fourth metallic heat conducting portion are generally parallel to each other in a direction of a second length-wise axis, wherein the first length-wise axis is perpendicular said second length-wise axis;

a frame supporting the cover, the frame having a second metallic exterior surface separated from a second metallic interior surface by at least a second insulation layer, wherein the second metallic exterior surface is thermally isolated from the second metallic interior surface; and a non-metallic, thermally insulating gasket disposed between the second metallic interior and exterior surfaces and the first metallic interior surface.

10. The roof access hatch of claim 9 wherein the third metallic heat conducting portion and the fourth metallic heat conducting portion are attached to the first metallic heat conducting portion and thermally isolated from the second metallic heat conducting portion.

11. The roof access hatch of claim 10 wherein said second metallic heat conducting portion is adjacent the first metallic interior surface and includes a hole.

12. The roof access hatch of claim 11 wherein walls circumscribing said hole are threaded.

13. The roof access hatch of claim 12 wherein a plurality of generally parallel first thermal breaks span the first insulation layer and contact both the first metallic exterior surface and the first metallic interior surface.

14. The roof access hatch of claim 11 wherein hardware mounted to the first metallic interior surface is attached via the hole.

15. The roof access hatch of claim 14 wherein the hardware includes a handle lock adjacent a first edge of the cover and a hinge adjacent an opposing second edge of the cover.

16. The roof access hatch of claim 9 wherein the second thermal break component is disposed between the second metallic exterior surface and the second metallic interior surface adjacent said thermally insulating gasket.

17. The roof access hatch of claim 16 wherein said fourth metallic heat conducting portion is adjacent the second metallic interior surface.

18. The roof access hatch of claim 17 wherein the fourth metallic heat conducting portion includes a hole.

19. The roof access hatch of claim 18 wherein walls circumscribing said hole are threaded.

* * * * *